US011763611B2

(12) United States Patent
Chen et al.

(10) Patent No.: US 11,763,611 B2
(45) Date of Patent: Sep. 19, 2023

(54) ELECTRONIC DOOR LOCK WITH UNLOCKING MONITORING FUNCTION AND WORKING METHOD THEREOF

(71) Applicant: Zhongshan Xianju Intelligent Technology Co., LTD., Zhongshan (CN)

(72) Inventors: Xijin Chen, Zhongshan (CN); Yinglong Chen, Zhongshan (CN)

(73) Assignee: Zhongshan Xianju Intelligent Technology Co., LTD., Zhongshan (CN)

( * ) Notice: Subject to any disclaimer, the term of this patent is extended or adjusted under 35 U.S.C. 154(b) by 60 days.

(21) Appl. No.: 17/716,866

(22) Filed: Apr. 8, 2022

(65) Prior Publication Data

US 2023/0230432 A1 Jul. 20, 2023

(30) Foreign Application Priority Data

Jan. 14, 2022 (CN) ..... 202210043624.6

(51) Int. Cl.
*G07C 9/00* (2020.01)

(52) U.S. Cl.
CPC ..... *G07C 9/00309* (2013.01); *G07C 9/00944* (2013.01)

(58) Field of Classification Search
None
See application file for complete search history.

(56) References Cited

U.S. PATENT DOCUMENTS 6,334,636 B1 * 1/2002 Huang ..... E05B 47/0012 292/341.16

* cited by examiner

*Primary Examiner* — K. Wong
(74) *Attorney, Agent, or Firm* — Georgi Korobanov

(57) ABSTRACT

The application discloses an electronic door lock with an unlocking monitoring function and a working method thereof, belonging to the technical field of intelligent locks, which comprises a lock body, a mechanical unlocking member connected to a deadbolt assembly, a main control board arranged in the lock body, and a micro switch electrically connected to the main control board. The mechanical unlocking member comprises a knob that is rotatably arranged on the lock body, and a paddle that is synchronously and coaxially driven by the knob. When the knob drives the deadbolt assembly to switch between the locked state and the unlocked state, the paddle can be rotated to trigger the micro switch. A wireless transmitting module for transmitting the trigger signal of the micro switch is integrated on the control board. The mechanical unlocking monitoring function is added.

10 Claims, 8 Drawing Sheets

ELECTRONIC DOOR LOCK WITH UNLOCKING MONITORING FUNCTION AND WORKING METHOD THEREOF

CROSS-REFERENCE TO RELATED APPLICATIONS

This application claims the benefit and priority of Chinese patent application No. 202210043624.6, filed on Jan. 14, 2022, disclosure of which is hereby incorporated by reference in its entirety.

TECHNICAL FIELD

The present application relates to the technical field of smart locks, in particular to an electronic door lock with unlocking monitoring function and a working method thereof.

BACKGROUND

At present, more and more families begin to use electronic door locks. With the technological development of electronic door locks, R&D personnel are constantly improving the user experience. The existing locks cannot monitor the mechanical unlocking methods such as knobs and keys, and the user experience effect is not well.

SUMMARY

In order to overcome the deficiencies of the prior art, the present application provides an electronic door lock with an unlocking monitoring function with a reasonable structure and an ingenious design.

The present application also provides the working method of the above electronic door lock.

The technical solution adopted by this application to solve its technical problems is:

An electronic door lock with unlocking monitoring function comprises a lock body, a mechanical unlocking member connected to a deadbolt assembly, a main control board arranged in the lock body, and a micro switch electrically connected to the main control board, the mechanical unlocking element comprising a knob that is rotatably arranged on the lock body, a paddle that is synchronously and coaxially driven by the knob, and when the knob drives the deadbolt assembly to switch between the locked state and the unlocked state, the paddle can be rotated to trigger the micro switch, and a wireless transmitting module for transmitting the trigger signal of the micro switch is integrated on the main control board.

Preferably, an electric unlocking member configured to clutch with the knob is further arranged in the lock body, wherein when the knob is rotated, the knob is configured not to drive the electric unlocking member to rotate, and the electric unlocking member is configured to be rotated until it is in contact with the knob and drives the knob to rotate.

Preferably, the electric unlocking member comprises a motor connected to the main control board, a driving wheel driven by the motor, a driven wheel driven by the driving wheel, a stop block with a first side and a second side is arranged on the knob, and the driven wheel is coaxially arranged on the knob, and an arc-shaped retaining ring configured to clutch with the stop block is arranged on the inner side wall of the driven wheel, wherein the arc-shaped retaining ring is configured at most to contact with one of the sides of the stop block.

Preferably, the knob is provided with a first clamping position and a second clamping position, wherein a first clamping spring and a second clamping spring for fixing the driven wheel and. the paddle are respectively clamped in the first clamping position and the second clamping position.

Preferably, the main control board is provided with a notch for positioning the elastic pieces of the micro switch.

Preferably, the assembling steps are as follows:

① Pass the knob through the lock body, clamp the first retaining ring to the first clamping position, and clamp the knob on the lock body;

② Adjust the direction of the driven wheel and the paddle, and install the driven wheel and the paddle on the knob coaxially in turn;

③ install the second clamping spring, and clamp the driven wheel and. the paddle between the first clamping spring and the second clamping spring;

④ The lock body is provided with an insertion post which is inserted into an insertion hole in the micro switch;

⑤ Lock the main control board at the preset position in the lock body, and the notch is configured to locate the elastic pieces of the micro switch;

⑥ comprises further a cover piece, the cover piece is provided with a pressure block, the cover piece is fixed in the lock body, and the pressure block is pressed against the micro switch.

Working method of an electronic door lock with an unlocking monitoring function comprises the following steps:

① Initial state: the first side of the stop block is in contact with the arc-shaped retaining ring;

② Mechanical unlocking: the knob is rotated in the first direction, the paddle is rotated under the driving of the knob and triggers the micro switch, and the main control board controls the wireless transmitter module to transmit a unlocking signal; at the same time, the driven wheel does not move, and the stop block is rotated until the second side is in contact with the arc-shaped retaining ring;

③ Mechanical locking: the knob is rotated in the opposite direction, the paddle is rotated under the driving of the knob and triggers the micro switch, and the main control board controls the wireless transmitter module to transmit a locking signal; at the same time, the driven wheel does not move, and the stop block is rotated until the first side is in contact with the arc-shaped retaining ring;

④ Electric unlocking: after the main control board receives a unlocking command, the motor works, the driven wheel is rotated in the first direction, and the arc-shaped retaining ring is always in contact with the first side of the stop block and drive the knob to rotate together, the paddle is rotated under the driving of the knob and triggers the micro switch, the main control board controls the wireless transmitter module to transmit the unlock signal; then, the motor works, the driven wheel is rotated in the opposite direction to reset, at this time, the knob does not move, and the arc-shaped retaining ring is rotated until it contacts the second side of the stop block;

⑤ Electrical locking: after the main control board receives a locking command, the motor works, the driven wheel is rotated in the opposite direction mechanically, and the arc-shaped retaining ring is always in contact with the second stop block and drives the knob to rotate together, the paddle is rotated under the driving of the knob and triggers the micro switch, the main control board controls the wireless transmitter module to transmit the lock signal; then, the motor works, the driven wheel is rotated in the first direction to reset, at this time, the knob does not move, and the arc-shaped retaining ring is rotated until it contacts the first side of the stopper.

Preferably, in step ⑤, the step of electrically locking further comprises that the main control board is configured to control the motor to drive the driven wheel according to a preset delay time, so as to rotate with the knob to realize automatic locking.

Preferably, the first direction is clockwise or counter-clockwise.

Preferably, in steps ④ and ⑤, the specific method for determining the reset position of the driven wheel is to use the Hall switch to sense the magnet on driven wheel.

The beneficial effects of this application are:

1. The mechanical unlocking monitoring function is added. When the mechanical unlocking part is rotated to unlock or lock, it will trigger the micro switch, and the micro switch will transmit the signal to the main control board, so that the receiving end can receive the mechanical unlocking information at the first time, its stability is very good, the cost is low, and the user experience effect is well;
2. The mechanical unlocking part and the electric unlocking part are closely matched, the structure is simple, the design is reasonable, and the working method is ingenious;
3. The installation of knob, driven wheel and paddle is realized by the clamping of the clamping spring, and the assembly is convenient and fast.

DETAILED DESCRIPTION

Figure 1:
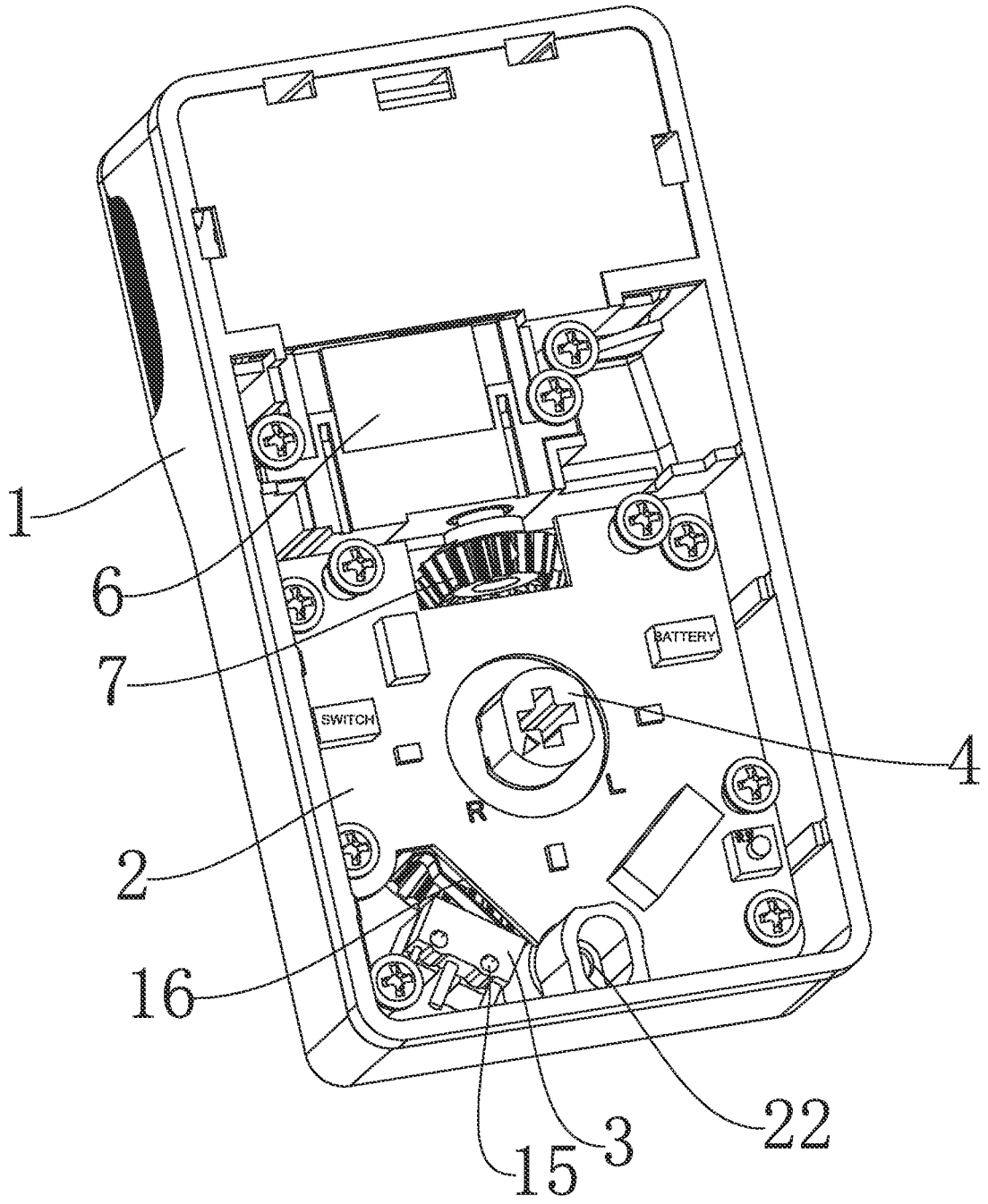
FIG. 1 is a schematic structural diagram of the present application.
Figure 2:
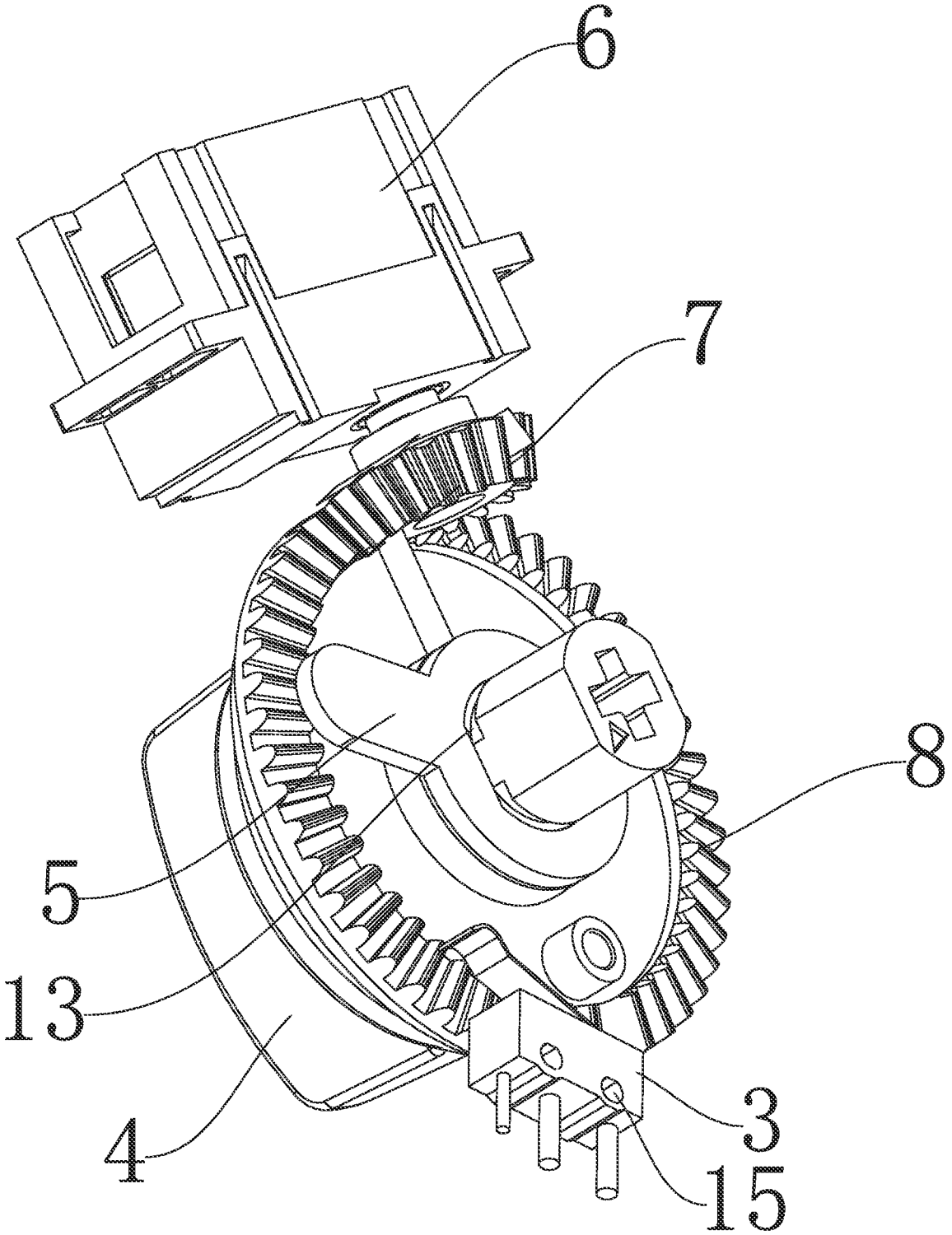
FIG. 2 is a schematic structural diagram of a mechanical unlocking member and an electronic unlocking member.

The technical solutions of the present application will be described in detail below with reference to the accompanying drawings and embodiments.

As shown in FIG. 1-8, the electronic door lock with unlock monitoring function comprises lock body 1, a mechanical unlocking member connected to a deadbolt assembly, a main control board 2 arranged in the lock body 1, and a micro switch 3 electrically connected to the main control board 2. The mechanical unlocking element comprises a knob 4 that is rotatably arranged on the lock body 1, a paddle 5 that is synchronously and coaxially driven by the knob 4. When the knob 4 drives the deadbolt assembly to switch between the locked state and the unlocked state, the paddle 5 can be rotated to trigger the micro switch 3, and a wireless transmitting module for transmitting the trigger signal of the micro switch 3 is integrated on the main control board 2.

This application is equipped with a mechanical unlocking monitoring function. When the mechanical unlocking part is rotated to unlock or lock, the paddle 5 will trigger the micro switch 3, and the micro switch 3 will transmit the signal to the main control board 2. The main control board 2 transmits the monitoring signal to the corresponding receiving end. The structure is reasonable, the design is ingenious, the cost is low, and the stability is strong, which is convenient for the receiving end to receive the mechanical unlocking information at the first time, and the user experience effect is good.

An electric unlocking member configured to clutch with the knob 4 is further arranged in the lock body 1. When the knob 4 is rotated, the knob is configured not to drive the electric unlocking member to rotate, and the electric unlocking member is configured to be rotated until it is in contact with the knob 4 and drives the knob 4 to rotate.

On the one hand, when the electric unlocking member is unlocked or locked, it drives the mechanical unlocking member to rotate, and also triggers the micro switch 3. The receiving end receives the electric unlocking information at the first time. The above-mentioned paddle 5 realizes double monitoring of the mechanical unlocking state and the electric unlocking state; on the other hand, the electric unlocking member does not interfere with the rotation of the mechanical unlocking member.

Specifically, the electric unlocking member comprises a motor 6 connected to the main control board 2, a driving wheel 7 driven by the motor 6, a driven wheel 8 driven by the driving wheel 7. A stop block 9 with a first side and a second side is arranged on the knob 4, and the driven wheel 8 is coaxially arranged on the knob 4, and an arc-shaped retaining ring 10 configured to clutch with the stop block 9 is arranged on the inner side wall of the driven wheel 8, wherein the arc-shaped retaining ring 10 is configured at most to contact with one of the sides of the stop block 9.

Figure 5:
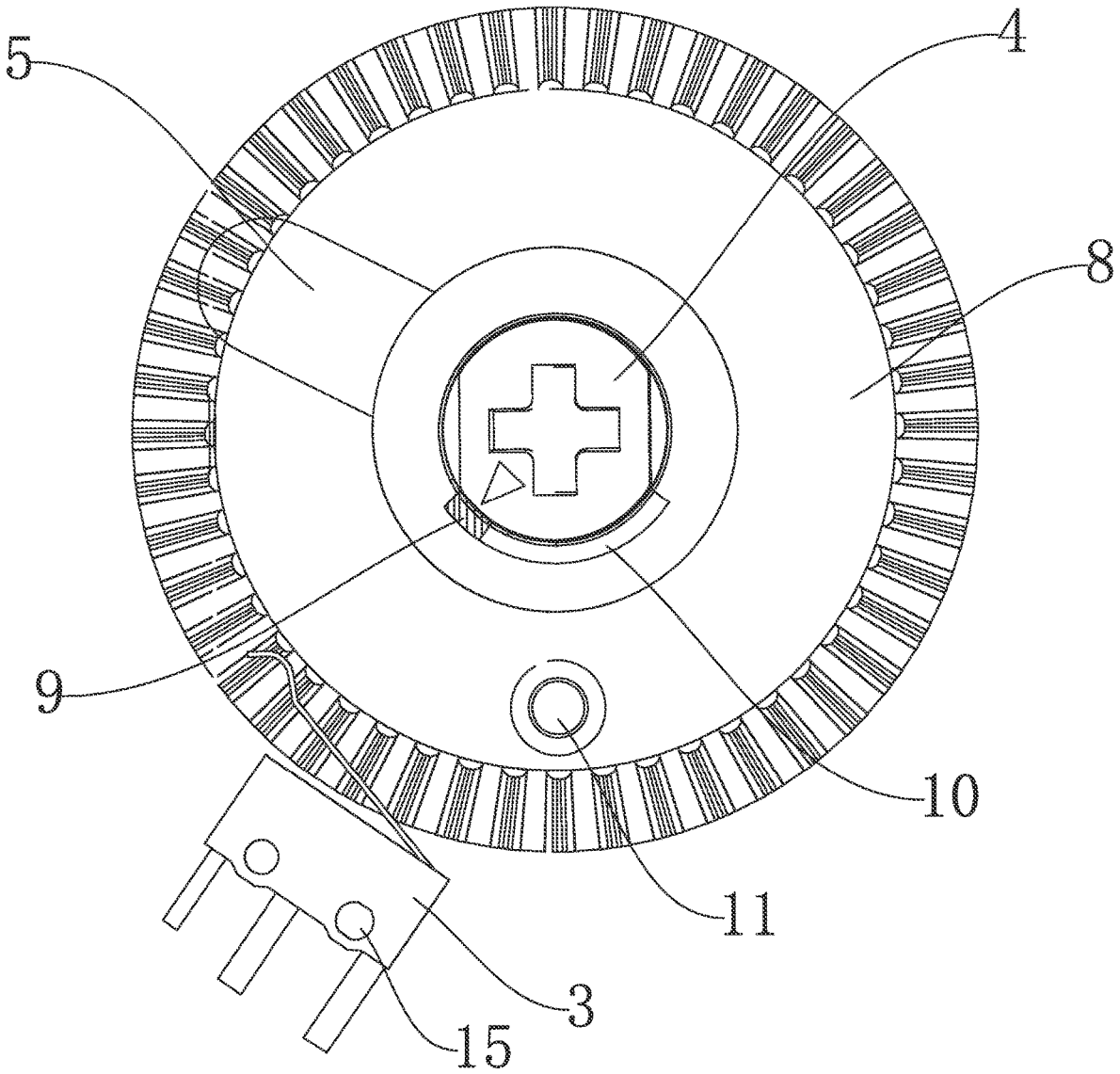
FIG. 5 is a schematic diagram of the deadbolt assembly in a locked state.

As shown in FIG. 5, the arc-shaped retaining ring 10 abuts against the first side surface of the stop block 9. After the knob 4 is rotated clockwise by a preset angle, the arc-shaped retaining ring 10 abuts against the second side surface of the stop block 9.

Further, the driven wheel 8 is provided with a magnet 11 and the main control board 2 is provided with a Hall switch, which detects the position of the magnet 11 and transmits the detection signal to the main control board 2.

The knob 4 is provided with a first clamping position 12 and a second clamping position 13, wherein a first clamping spring and a second clamping spring for fixing the driven wheel 8 and the paddle 5 are respectively clamped in the first clamping position 12 and the second clamping position 13. When assembling, after the knob 4 has passed through the lock body 1, the first clamping spring is fixed in the first clamping position 12 to achieve quick installation of the knob 4. Subsequently, the driven wheel 8 and the paddle 5 are installed coaxially on the knob 4 in turn, and the driven wheel 8 and the paddle 5 are fixed between the first and second clamping springs by using the second clamping spring. The above method is quick and efficient in disassembly and assembly, and the manufacturing cost is low.

In order to facilitate the installation of the micro switch 3, a insertion post 14 and a insertion hole 15 are arranged between the lock body 1 and the micro switch 3. One of the insertion post 14 and the insertion hole 15 is arranged on the lock body 1, and the other is arranged on the micro switch 3. In this embodiment, the lock body 1 is integrally formed with an insertion post 14, and the micro switch 3 is provided with a corresponding insertion hole 15. The insertion post 14 is inserted into the insertion hole 15 so as to realize the quick positioning and installation of the micro switch 3.

The main control board 2 is provided with a notch 16 for positioning the elastic pieces of the micro switch 3. When the main control board 2 is locked in the lock body 1 by screws, the above-mentioned notches 16 can limit the elastic pieces of the micro switch 3, so that the elastic pieces can be accurately triggered when the paddle 5 rotates.

Figure 3:
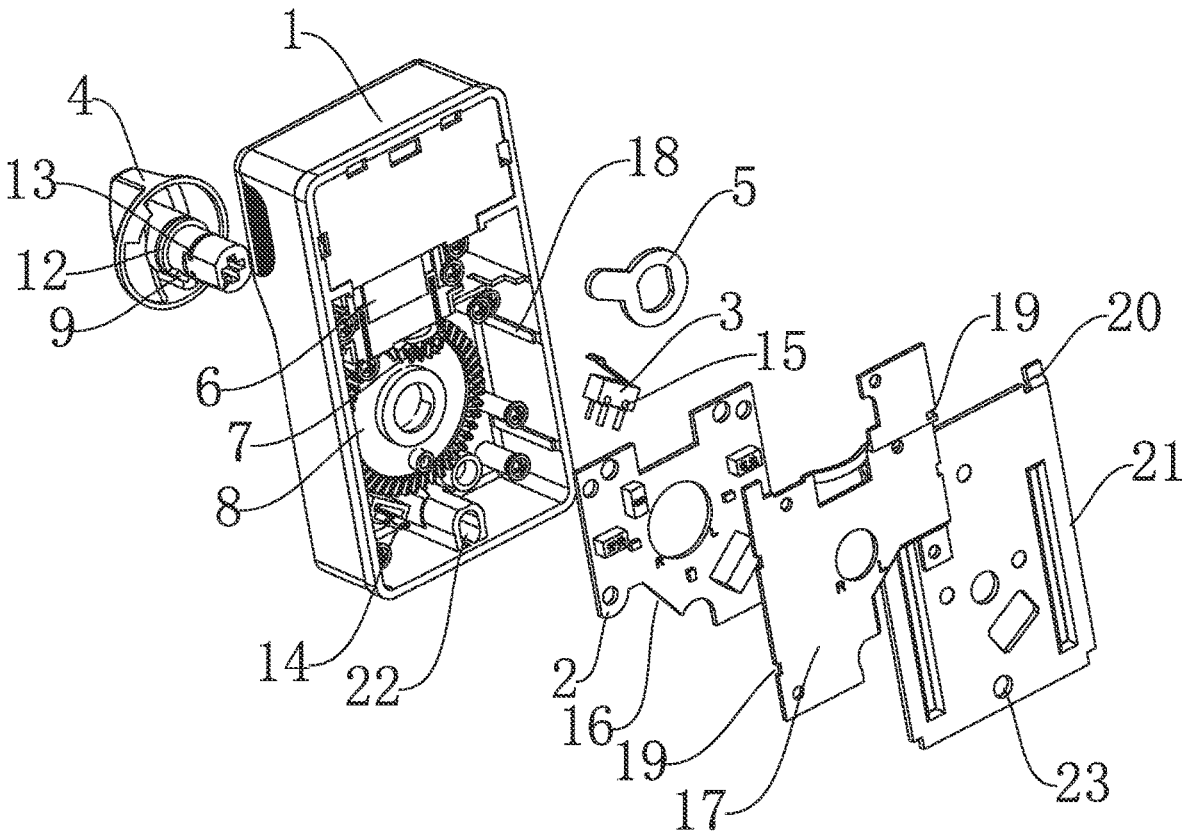
FIG. 3 is the exploded schematic diagram of the present application.
Figure 4:
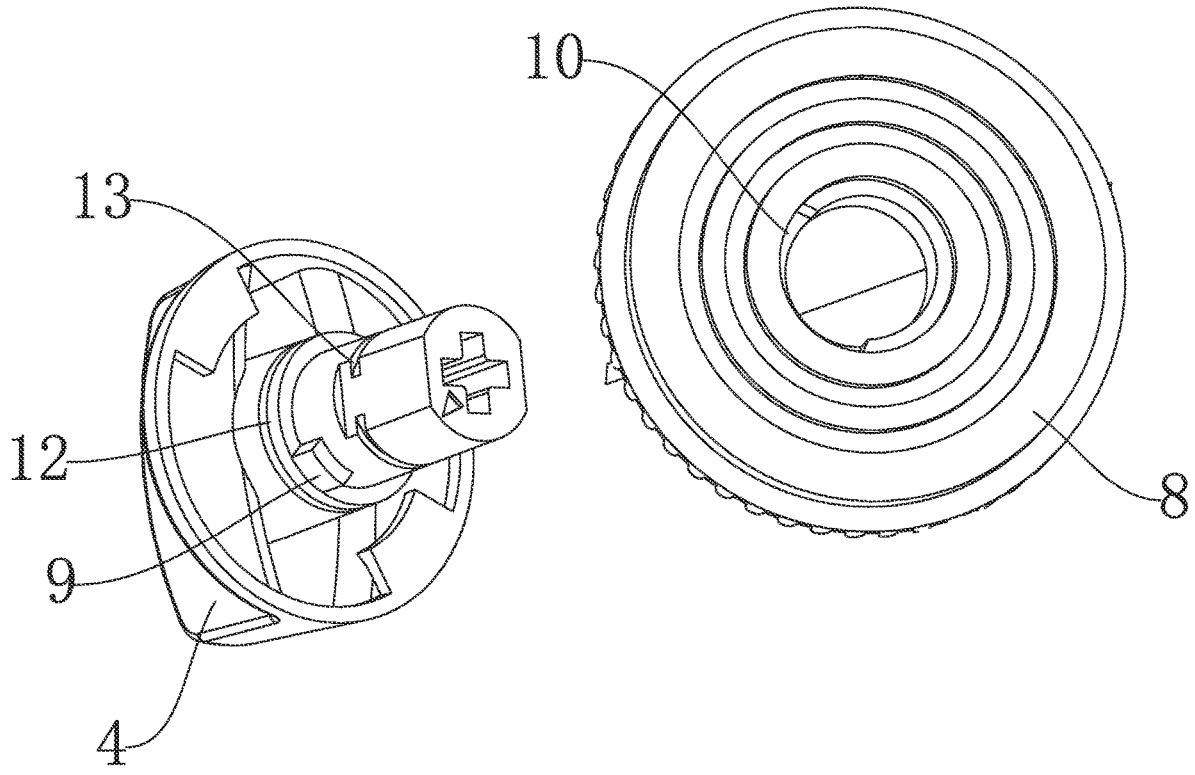
FIG. 4 is the structural diagram of knob and driven wheel.

As shown in FIG. 3, the present application also comprises a cover piece 17, a plurality of guide ridges 18 are provided on the inner side wall of the lock body 1, and guide ports 19 corresponding to the guide ridges 18 are provided on the cover piece 17. The cover piece 17 can be quickly snapped into the lock body 1 through the cooperation of the guide ridges 18 and the guide block. The cover piece 17 is provided with a pressing block on the side facing the main control board 2. When the pressure block is pressed against the micro switch 3, the micro switch 3 can be prevented from being separated from the insertion post 14.

The application has low cost, strong stability and convenient installation. The assembly steps are as follows:

① Pass the knob 4 through the lock body 1, clamp the first retaining ring to the first clamping position 12, and clamp the knob 4 on the lock body 1;

② Adjust the direction of the driven wheel 8 and the paddle 5, and install the driven wheel 8 and the paddle 5 on the knob 4 coaxially in turn;

③ Install the second clamping spring, and clamp the driven wheel 8 and the paddle 5 between the first clamping spring and the second clamping spring;

④ The lock body 1 is provided with an insertion post 14 which is inserted into an insertion hole 15 in the micro switch 3;

⑤ Lock the main control board 2 at the preset position in the lock body 1, and the notch 16 is configured to locate the elastic pieces of the micro switch 3;

⑥ the cover piece 17 is fixed in the lock body 1, and the pressure block is pressed against the micro switch 3.

Working method of an electronic door lock with an unlocking monitoring function comprises the following steps:

① Initial state: the first side of the stop block 9 is in contact with the arc-shaped retaining ring (10);

② Mechanical unlocking: the knob 4 is rotated in the first direction, the paddle 5 is rotated under the driving of the knob 4 and triggers the micro switch 3, and the main control board 2 controls the wireless transmitter module to transmit a unlocking signal; at the same time, the driven wheel 8 does not move, and the stop block 9 is rotated until the second side is in contact with the arc-shaped retaining ring 10;

③ Mechanical locking: the knob 4 is rotated in the opposite direction, the paddle 5 is rotated under the driving of the knob 4 and triggers the micro switch 3, and the main control board 2 controls the wireless transmitter module to transmit a locking signal; at the same time, the driven wheel 8 does not move, and the stop block 9 is rotated until the first side is in contact with the arc-shaped retaining ring 10;

④ Electric unlocking: after the main control board 2 receives a unlocking command, the motor 6 works, the driven wheel 8 is rotated in the first direction, and the arc-shaped retaining ring 10 is always in contact with the first side of the stop block 9 and drive the knob 4 to rotate together, the paddle 5 is rotated under the driving of the knob 4 and triggers the micro switch 3, the main control board 2 controls the wireless transmitter module to transmit the unlock signal; then, the motor 6 works, the driven wheel 8 is rotated in the opposite direction to reset, at this time, the knob 4 does not move, and the arc-shaped retaining ring 10 is rotated until it contacts the second side of the stop block 9;

⑤ Electrical locking: after the main control board 2 receives a locking command, the motor 6 works, the driven wheel 8 is rotated in the opposite direction mechanically, and the arc-shaped retaining ring 10 is always in contact with the second stop block 9 and drives the knob 4 to rotate together, the paddle 5 is rotated under the driving of the knob 4 and triggers the micro switch 3, the main control board 2 controls the wireless transmitter module to transmit the lock signal; then, the motor 6 works, the driven wheel 8 is rotated in the first direction to reset, at this time, the knob 4 does not move, and the arc-shaped retaining ring 10 is rotated until it contacts the first side of the stopper 9.

In step ⑤, the step of electrically locking further comprises that the main control board 2 is configured to control the motor 6 to drive the driven wheel 8 according to a preset delay time, so as to rotate with the knob 4 to realize automatic locking.

In steps ④ and ⑤, the specific method for determining the reset position of the driven wheel 8 is to use the Hall switch to sense the magnet 11 on driven wheel 8.

The above-mentioned first direction may be clockwise or counterclockwise, which is determined according to the specific left and right door opening method.

Figure 6:
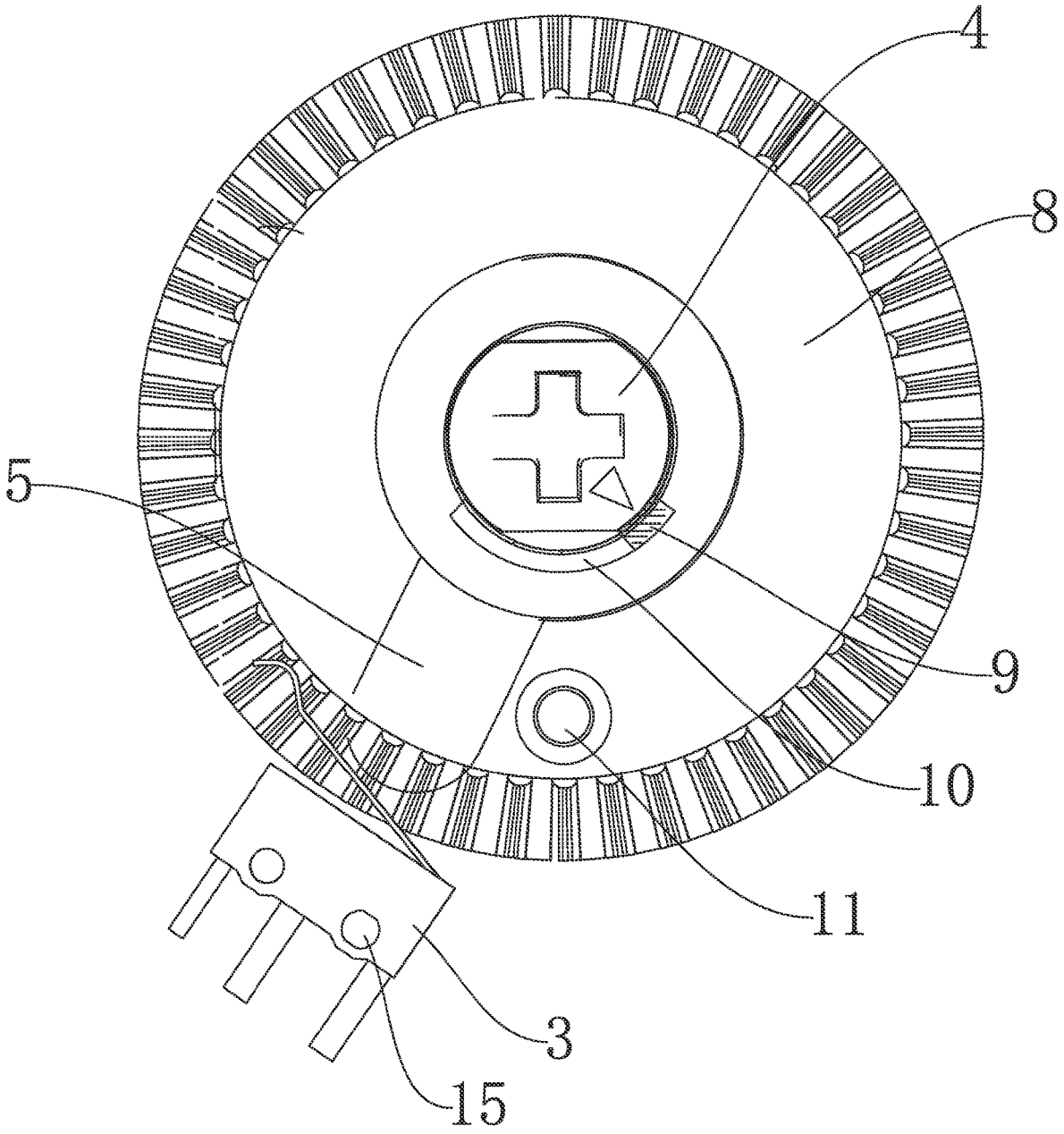
FIG. 6 is the schematic diagam when the mechanical unlocking element drives the deadbolt assembly to unlock.
Figure 7:
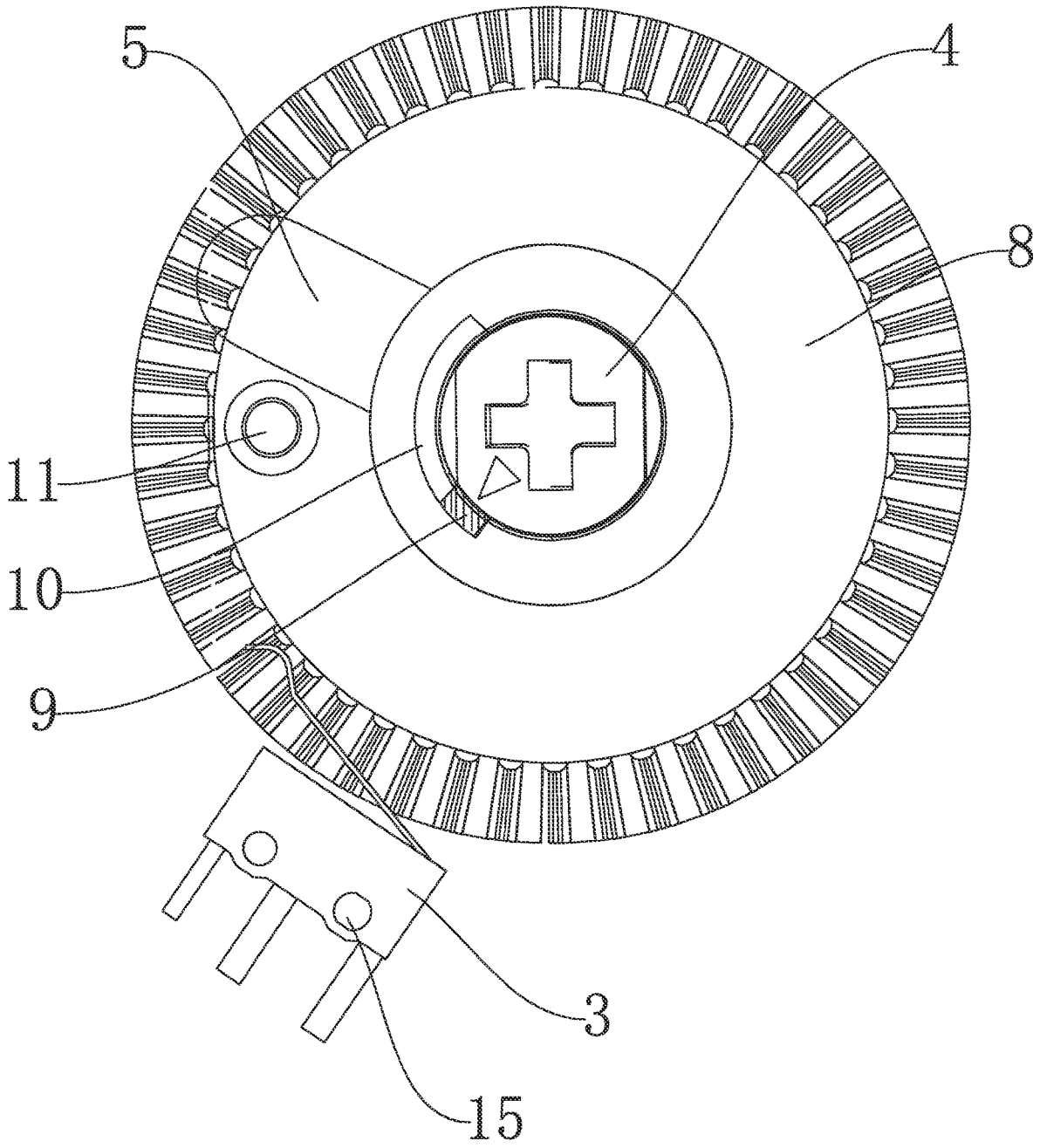
FIG. 7 is the schematic diagram when the electronic unlocking element drives the deadbolt assembly to lock automatically.

Combined with FIG. 5-7, the state changes of mechanical unlocking are as follows:

1. As shown in FIG. 5, the deadbolt assembly is in the initial state of locking, and the first side of the stop block 9 is in contact with the arc-shaped retaining ring 10;
2. As shown in FIG. 6, when the mechanical unlock is performed, the knob 4 rotates 90° counterclockwise. On the one hand, the paddle 5 triggers the micro switch 3, the micro switch 3 transmits the signal to the main control board 2, and the receiving end receives the mechanical unlock information; On the other hand, the driven wheel 8 does not move, and the stop block 9 is rotated to the second side to contact with the arc-shaped retaining ring 10;
3. As shown in FIG. 7, after the preset delay time after unlocking, the motor 6 works, and the driven wheel 8 drives the knob 4 to rotate 90° clockwise to realize automatic locking. At the same time, the paddle 5 triggers the micro switch 3 again, the micro switch 3 transmits the signal to the main control board 2, and the receiving end receives the locking information;
4. Subsequently, the motor 6 controls the driven wheel 8 to rotate 90° counterclockwise to reset. At this time, the knob 4 does not move, and the driven wheel 8 is reset to the initial state shown in FIG. 5, that is, the first side of the stop block 9 is in contact with the arc-shaped retaining ring 10.

Figure 8:
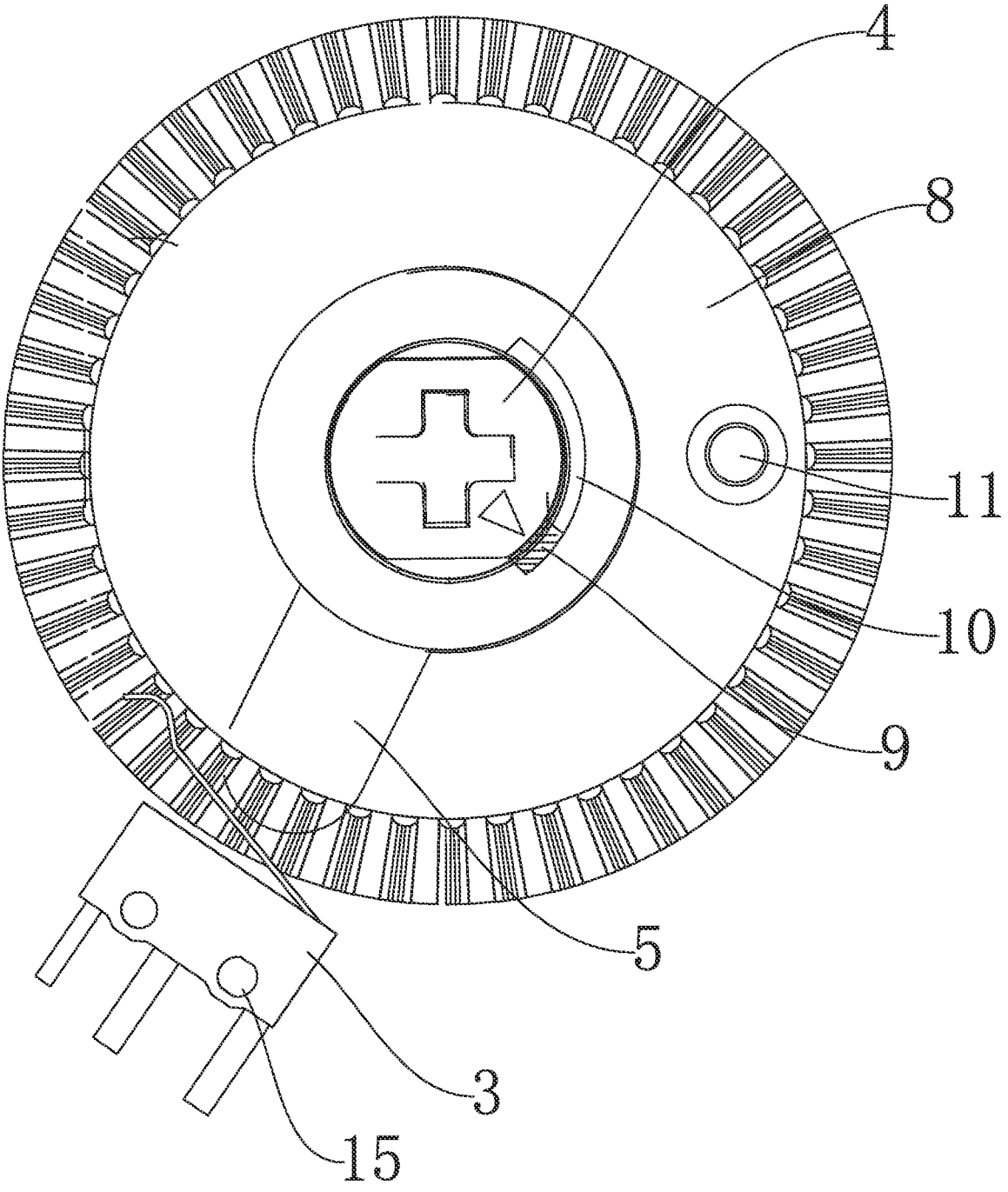
FIG. 8 is a schematic diagram when the electronic unlocking element drives the deadbolt assembly to unlock.

Combined with FIG. 5, FIG. 7 and FIG. 8, the state changes of the electric unlocking are as follows:

1. As shown in FIG. 5, the deadboh assembly is in the initial state of locking, and the first side of the stop block 9 is in contact with the arc-shaped retaining ring 10;
2. As shown in FIG. 8, when unlocking electrically, the motor 6 works, and the driven wheel 8 drives the knob 4 to rotate 90° counterclockwise together. On the one hand, the paddle 5 triggers the micro switch 3, and the micro switch 3 transmits the signal to the main control board 2. The receiving end receives the electric unlocking information; on the other hand, the knob 4 rotates with the driven wheel 8, and the first side of the stop block 9 is always in contact with the arc-shaped retaining ring 10;
3. Subsequently, the motor 6 works, and the driven wheel 8 rotates 90° clockwise to reset to the state shown in FIG. 6.

At this time, the knob 4 does not move, and the stop block 9 rotates until the second side is in contact with the arc-shaped retaining ring 10;

4. As shown in FIG. 7, after the preset delay time after unlocking, the motor 6 works, and the driven wheel 8 drives the knob 4 to continue to rotate 90° clockwise to realize automatic locking. At the same time, the paddle 5 triggers the micro switch 3 again, the micro switch 3 transmits the signal to the main control board 2, and the receiving end receives the locking information. During the rotation process, the second side of the stop block 9 is always in contact with the arc-shaped retaining ring 10;

5. Finally, the motor 6 controls the driven wheel 8 to rotate 90° counterclockwise to reset. At this time, the knob 4 does not move, the driven wheel 8 is reset to the initial state shown in FIG. 5, and the arc-shaped retaining ring 10 is rotated to contact the first side of the stop block 9.

In addition, as shown in FIG. 3, the present application also comprises a bottom plate 21 with a hanging tongue 20 at the upper end, one end of the lock body 1 is suspended on the hanging tongue 20, and the other end of the lock body 1 is fixedly connected to the bottom plate 21. By hanging the lock body 1 on the bottom plate 21, the number of screws required for connection between the two is reduced, thereby reducing the workload of screwing the screws, reducing the assembly difficulty and assembly labor cost, and the connection stability is strong.

The lock body 1 is provided with a long hole 22, and the bottom plate 21 is provided with a screw hole 23. The screw can pass through the long hole 22 and the screw hole 23 to realize the fixed connection between the lock body 1 and the bottom plate 21. By arranging the elongated hole 22, the up and down fine adjustment of the position of the lock body 1 on the bottom plate 21 can be realized, and the versatility is stronger.

The two hanging tongues 20 on the bottom plate 21 are matched and connected with the two sockets on the lock body 1 in a one-to-one correspondence, and combined with the locking of the elongated hole 22, three-point assembly is realized, the assembly operation is convenient, and the labor cost is reduced.

The above are only the preferred embodiments of the present application, and are not intended to limit the present application. Therefore, any modification, equivalent replacement, improvement, etc. made to the above embodiments according to the technical practice of the present application still fall within the scope of the technical solution of the present application.

What is claimed is:

1. An electronic door lock with unlocking monitoring function comprising a lock body (1), a mechanical unlocking member connected to a deadbolt assembly, a main control board (2) arranged in the lock body (1), and a micro switch (3) electrically connected to the main control board (2), the mechanical unlocking element comprising a knob (4) that is rotatably arranged on the lock body (1), a paddle (5) that is synchronously and coaxially driven by the knob (4), and when the knob (4) drives the deadbolt assembly to switch between the locked state and the unlocked state, the paddle (5) can be rotated to trigger the micro switch (3), and a wireless transmitting module for transmitting the trigger signal of the micro switch (3) is integrated on the main control board (2).

2. The electronic door lock with unlocking monitoring function according to claim 1, wherein an electric unlocking member configured to clutch with the knob (4) is further arranged in the lock body (1), wherein when the knob (4) is rotated, the knob is configured not to drive the electric unlocking member to rotate, and the electric unlocking member is configured to be rotated until it is in contact with the knob (4) and drives the knob (4) to rotate.

3. The electronic door lock with unlocking monitoring function according to claim 2, wherein the electric unlocking member comprises a motor (6) connected to the main control board (2), a driving wheel (7) driven by the motor (6), a driven wheel (8) driven by the driving wheel (7), a stop block (9) with a first side and a second side is arranged on the knob (4), and the driven wheel (8) is coaxially arranged on the knob (4), and an arc-shaped retaining ring (10) configured to clutch with the stop block (9) is arranged on the inner side wall of the driven wheel (8), wherein the arc-shaped retaining ring (10) is configured at most to contact with one of the sides of the stop block (9).

4. The electronic door lock with unlocking monitoring function according to claim 3, wherein the knob (4) is provided with a first clamping position (12) and a second clamping position (13), wherein a first clamping spring and a second. clamping spring for fixing the driven wheel (8) and the paddle (5) are respectively clamped in the first clamping position (12) and the second clamping position (13).

5. The electronic door lock with unlocking monitoring function according to claim 1, wherein the main control board (2) is provided with a notch (16) for positioning the elastic pieces of the micro switch (3).

6. The electronic door lock with unlocking monitoring function according to claim 4, wherein the assembling steps are as follows:

① Pass the knob (4) through the lock body (1), clamp the first retaining ring to the first clamping position (12), and clamp the knob (4) on the lock body (1);

② Adjust the direction of the driven wheel (8) and the paddle (5), and install the driven wheel (8) and the paddle (5) on the knob (4) coaxially in turn;

③ Install the second clamping spring, and clamp the driven wheel (8) and the paddle (5) between the first clamping spring and the second clamping spring;

④ The lock body (1) is provided with an insertion post (14) which is inserted into an insertion hole (15) in the micro switch (3);

⑤ Lock the main control board (2) at the preset position in the lock body (1), and the notch (16) is configured to locate the elastic pieces of the micro switch. (3);

⑥ comprises further a cover piece (17), the cover piece (17) is provided with a pressure block, the cover piece (17) is fixed in the lock body (1), and the pressure block is pressed against the micro switch (3).

7. Working method of an electronic door lock with an unlocking monitoring function, comprising the following steps:

① Initial state: the first side of the stop block (9) is in contact with the arc-shaped retaining ring (10);

② Mechanical unlocking: the knob (4) is rotated in the first direction, the paddle (5) is rotated under the driving of the knob (4) and triggers the micro switch (3), and the main control board (2) controls the wireless transmitter module to transmit a unlocking signal; at the same time, the driven wheel (8) does not move, and the stop block (9) is rotated until the second side is in contact with the arc-shaped retaining ring (10);

③ Mechanical locking: the knob (4) is rotated in the opposite direction, the paddle (5) is rotated under the driving of the knob (4) and triggers the micro switch (3), and the main control board (2) controls the wireless transmitter module to transmit a locking signal; at the same time, the driven wheel (8) does not move, and the stop block (9) is rotated until the first side is in contact with the arc-shaped retaining ring (10);

④ Electric unlocking: after the main control board (2) receives a unlocking command, the motor (6) works, the driven wheel (8) is rotated in the first direction, and the arc shaped retaining ring (10) is always in contact with the first side of the stop block (9) and drive the knob (4) to rotate together, the paddle (5) is rotated under the driving of the knob (4) and triggers the micro switch (3), the main control board (2) controls the wireless transmitter module to transmit the unlock signal; then, the motor (6) works, the driven wheel (8) is rotated in the opposite direction. to reset, at this time, the knob (4) does not move, and the arc-shaped retaining ring (10) is rotated until it contacts the second side of the stop block (9);

⑤ Electrical locking: after the main control board (2) receives a locking command, the motor (6) works, the driven wheel (8) is rotated in the opposite direction mechanically, and the arc-shaped retaining ring (10) is always in contact with the second stop block (9) and drives the knob (4) to rotate together, the paddle (5) is rotated under the driving of the knob (4) and triggers the micro switch (3), the main control board (2) controls the wireless transmitter module to transmit the lock signal; then, the motor (6) works, the driven Wheel (8) is rotated in the first direction to reset, at this time, the knob (4) does not move, and the arc-shaped retaining ring (10) is rotated until it contacts the first side of the stopper (9).

8. The working method of an electronic door lock with unlocking monitoring function according to claim 7, wherein in step ⑤, the step of electrically locking further comprises that the main control board (2) is configured to control the motor (6) to drive the driven wheel (8) according to a preset delay time, so as to rotate with the knob (4) to realize automatic locking.

9. The working method of an electronic door lock with unlocking monitoring function according to claim 7, wherein the first direction is clockwise or counterclockwise.

10. The working method of the electronic door lock with unlocking monitoring function. according to claim 7, characterized in that, in steps ④ and ⑤, the specific method for determining the reset position of the driven wheel (8) is to use the Hall switch to sense the magnet (11) on driven wheel (8).

* * * * *